US009830757B2

(12) United States Patent
Weicker et al.

(10) Patent No.: US 9,830,757 B2
(45) Date of Patent: Nov. 28, 2017

(54) SYSTEM AND METHOD FOR OPERATING VEHICLE USING MOBILE DEVICE

(71) Applicant: Faraday & Future Inc., Gardena, CA (US)

(72) Inventors: Phillip John Weicker, Pasadena, CA (US); Anil Paryani, Cerritos, CA (US)

(73) Assignee: FARADAY & FUTURE INC., Gardena, CA (US)

( * ) Notice: Subject to any disclaimer, the term of this patent is extended or adjusted under 35 U.S.C. 154(b) by 125 days.

(21) Appl. No.: 14/871,874

(22) Filed: Sep. 30, 2015

(65) Prior Publication Data

US 2017/0092028 A1 Mar. 30, 2017

(51) Int. Cl.
*G07C 9/00* (2006.01)

(52) U.S. Cl.
CPC ..... *G07C 9/00039* (2013.01); *G07C 9/00309* (2013.01); *G07C 9/0069* (2013.01); *G07C 2009/00769* (2013.01)

(58) Field of Classification Search
CPC ..... G07C 9/00039; G07C 9/00309; G07C 2009/00769; G07C 9/0069; B60R 25/00; G06F 21/00; G06F 9/445
USPC ..... 340/5.54; 701/29; 726/6
See application file for complete search history.

(56) References Cited

U.S. PATENT DOCUMENTS

| | | | | |
|---|---|---|---|---|
| 7,966,111 | B2 * | 6/2011 | Moinzadeh | B60R 25/00 379/201.01 |
| 8,484,707 | B1 * | 7/2013 | Bertz | B60R 25/24 705/65 |
| 2015/0095190 | A1 * | 4/2015 | Hammad | G06Q 20/14 705/26.8 |

* cited by examiner

*Primary Examiner* — Ali Neyzari
(74) *Attorney, Agent, or Firm* — Finnegan, Henderson, Farabow, Garrett & Dunner

(57) ABSTRACT

A method of for authenticating a mobile device for operating a vehicle may include receiving, by a receiver of the vehicle, an operation request from the mobile device to actuate an operation of the vehicle and generating, by a controller of the vehicle, a locally-perceivable signal indicative of a passcode granting a connection with the mobile device, in response to the received operation request. The method may further include receiving, by the receiver of the vehicle, information relating to the passcode from the mobile device, and establishing the connection with the mobile device for actuating the operation of the vehicle if the received information is authenticated.

16 Claims, 3 Drawing Sheets

SYSTEM AND METHOD FOR OPERATING VEHICLE USING MOBILE DEVICE

TECHNICAL FIELD

The present disclosure generally relates to systems and methods for operating a vehicle, and more specifically relates to systems and methods for authenticating a mobile device for operating the vehicle.

BACKGROUND

Keyless entry systems for automobiles use portable transmitters (often also called "fobs"). These systems usually include a receiver installed in a vehicle and a small-sized fob carried by an operator of the vehicle. The operator may perform certain functions, for example, locking or unlocking the vehicle, by transmitting, via the fob, encoded radio frequency (RF) signals to the receiver in the vehicle. Although this method may be easy to implement, there are some shortcomings. For example, the operator may be unable to enter or operate the vehicle without carrying the fob (e.g., the operator may have left the fob at home).

Such inconvenience may be solved by controlling vehicles remotely over a network or the Internet. However, these solutions raise great security concerns because authentication codes are often times transmitted over a public network, and thus vulnerable to hacks.

Accordingly, there is a need for an authentication system and method that provides and receives authentication information locally. The present disclosure aims to provide a system that addresses at least some of above-discussed considerations.

SUMMARY

One aspect of the present disclosure is directed to a system for authenticating a mobile device for operating a vehicle. The system may include a receiver that may receive an operation request from the mobile device to actuate an operation of the vehicle. The system may also include a controller that may generate a locally-perceivable signal indicative of a passcode granting a connection with the mobile device, in response to the received operation request. The receiver may also receive, from the mobile device, information relating to the passcode. The controller may further establish the connection with the mobile device for actuating the operation of the vehicle if the received information is authenticated.

Another aspect of the present disclosure is directed to a method for authenticating a mobile device for operating a vehicle. The method may include receiving, by a receiver of the vehicle, an operation request from the mobile device to actuate an operation of the vehicle, and generating, by a controller of the vehicle, a locally-perceivable signal indicative of a passcode granting a connection with the mobile device, in response to the received operation request. The method may further include receiving, by the receiver of the vehicle, information relating to the passcode from the mobile device, and establishing the connection with the mobile device for actuating the operation of the vehicle if the received information is authenticated.

Yet another aspect of the present disclosure is directed to a non-transitory computer-readable medium storing instructions which, when executed, cause one or more processors to perform a method for authenticating a mobile device for operating a vehicle. The method may include receiving, by a receiver of the vehicle, an operation request from the mobile device to actuate an operation of the vehicle, and generating, by a controller of the vehicle, a locally-perceivable signal indicative of a passcode granting a connection with the mobile device, in response to the received operation request. The method may further include receiving, by the receiver of the vehicle, information relating to the passcode from the mobile device, and establishing the connection with the mobile device for actuating the operation of the vehicle if the received information is authenticated.

DETAILED DESCRIPTION

The disclosure is directed to a system and method for authenticating a mobile device for operating a vehicle. It is contemplated that the vehicle may be an electric vehicle, a fuel cell vehicle, a hybrid vehicle, or a conventional internal combustion engine vehicle. The vehicle may have any body style, such as a sports car, a coupe, a sedan, a pick-up truck, a station wagon, a sports utility vehicle (SUV), a minivan, or a conversion van. The vehicle may be configured to be operated by an operator, occupying vehicle, remotely controlled, and/or autonomous.

In some embodiments, the system may receive an operation request (e.g., a request to unlock a door of the vehicle, or otherwise operate the vehicle) from the mobile device. The system may generate a locally-perceivable signal indicating of a passcode granting a connection with the mobile device, in response to the operation request. The mobile device may receive the signal and transmit information relating to the passcode to the system. The system may then establish the connection with the mobile device and/or perform the requested operation of the vehicle if the information received from the mobile device matches with the passcode.

Figure 1:
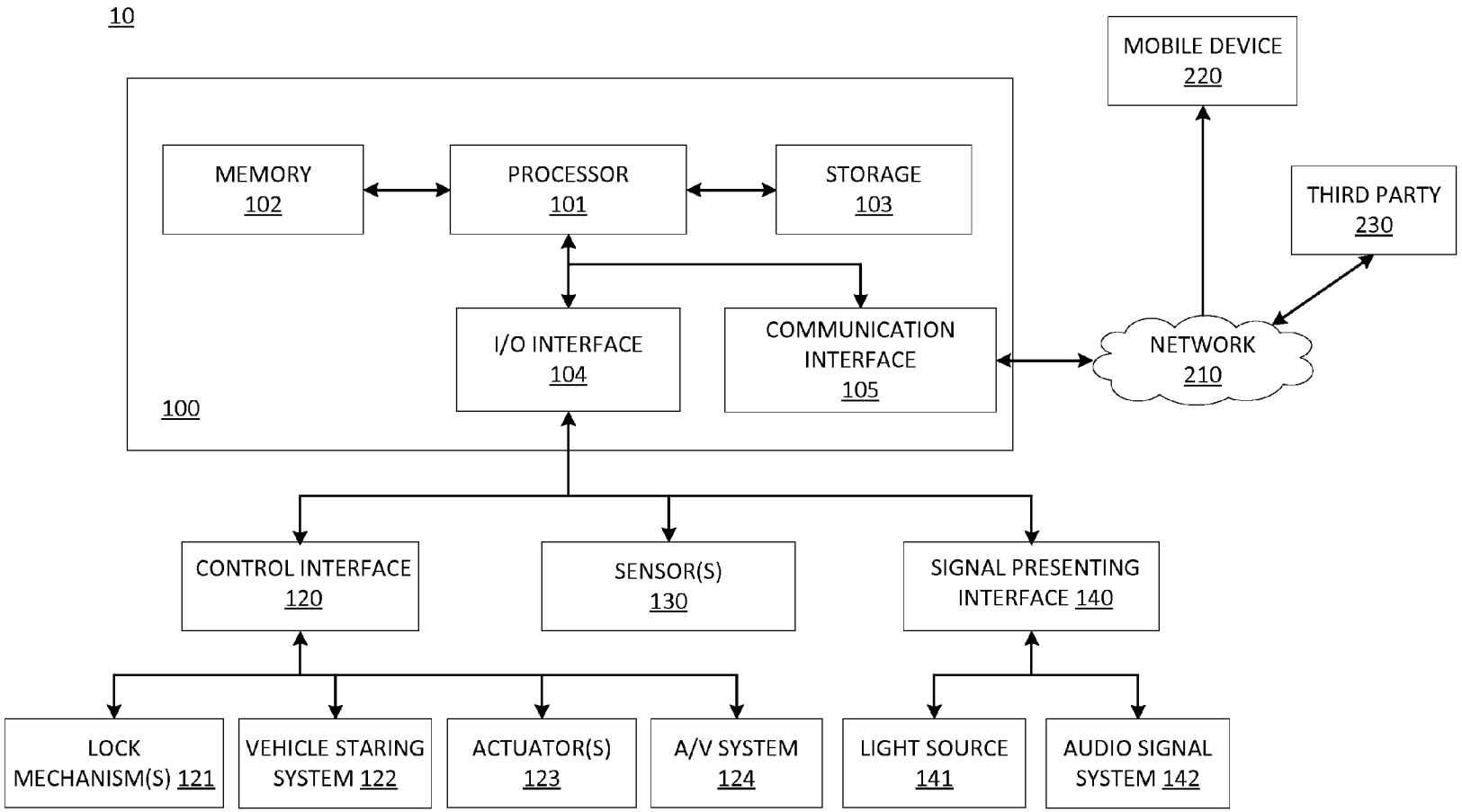
FIG. 1 is a block diagram of an exemplary system for authenticating a mobile device for operating of a vehicle.

FIG. 1 is a block diagram of an exemplary embodiment of a system for authenticating a mobile device for operating a vehicle. As illustrated in FIG. 1, system 10 may include a controller 100, a control interface 120, one or more sensors 130, and a signal presenting interface 140. Consistent with some embodiments, system 10 may receive a user request for operating the vehicle from a mobile device. One or more sensors 130 may be configured to detect the position of a mobile device. Controller 100 may generate a signal for authenticating the mobile device and the signal may be presented on one or more signal presenting devices through signal presenting interface 140. For example, light source 141 (e.g., head lamps, tail lamps, etc.) and/or audio signal system 142 (e.g., alarm device, etc.) may be configured to present a locally perceivable signal indicative of a passcode as described in this application. Once the mobile device is authenticated, the requested operation may be performed. For example, via control interface 120, controller 100 may control components such as door lock mechanisms 121, a vehicle starting system 122, one or more actuators 123, and an audio/video (A/V) system 124 to perform various operations of the vehicle.

Controller 100 may include, among other things, a processor 101, a memory 102, a storage 103, an I/O interface 104, and a communication interface 105. At least some of these components of controller 100 may be configured to transfer data and send or receive instructions between or among each other.

Processor 101 may include any appropriate type of general-purpose or special-purpose microprocessor, digital signal processor, or microcontroller. Processor 101 may be configured as a separate processor module dedicated to the mobile device authentication. Alternatively, processor 101 may be configured as a shared processor module for performing other functions unrelated to the mobile device authentication.

Processor 101 may be configured to receive data and/or signals from components of system 10 and process the data and/or signals to determine one or more conditions of the operations of system 10. For example, processor 101 may receive information relating to the passcode from mobile device 220 via, for example, communication interface 105. Processor 101 may further determine whether the information received matches with the passcode generated. Processor 101 may also generate and transmit a control signal for actuating one or more components of system 10. For example, if the information received from mobile device 220 matches with the passcode, processor 101 may instruct control interface 120 to control lock mechanism 121 to unlock a door.

Processor 101 may execute computer instructions (program codes) stored in memory 102 and/or storage 103, and may perform functions in accordance with exemplary techniques described in this disclosure. More exemplary functions of processor 101 will be described later in connection with FIG. 4.

Memory 102 and storage 103 may include any appropriate type of mass storage provided to store any type of information that processor 101 may need to operate. Memory 102 and storage 103 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 102 and/or storage 103 may be configured to store one or more computer programs that may be executed by processor 101 to perform exemplary authentication functions disclosed in this application. For example, memory 102 and/or storage 103 may be configured to store program(s) that may be executed by processor 101 to generate a passcode for granting a connection with the mobile device.

Memory 102 and/or storage 103 may be further configured to store information and data used by processor 101. For instance, memory 102 and/or storage 103 may be configured to store a passcode generated and the relevant data (e.g., a life-span of the passcode, etc.). Memory 102 and/or storage 103 may also store information relating to one or more operators (or the owner of the vehicle or authorized persons) and/or mobile device(s) 220 associated with the operators. Memory 102 and/or storage 103 may also store the parameters used by processor 101 in the process as described in this application. For example, memory 102 and/or storage 103 may store a distance from a vehicle for detecting whether an operator (or mobile device 220) is within proximity of the vehicle (i.e., the stored distance). More exemplary functions of memory 102 and storage 103 will be described later in connection with FIG. 4.

I/O interface 104 may be configured to facilitate the communication between controller 100, other components of system 10, mobile device 220, and third party 230 (e.g., a police station or security firm). For example, I/O interface 104 may receive an operation request from mobile device 220, via communication interface 105 over network 220, and transmit data relating to the operation request to processor 101 for further processing. I/O interface 104 may also receive data and/or signals from one or more sensors 130 for detecting the mobile device within a proximity of the vehicle, and transmit the data and/or signals to processor 101 for further processing. I/O interface 104 may also receive one or more control signals from processor 101, and transmit the signals to control interface 120 for controlling the operations of one or more lock mechanisms 121, vehicle starting system 122, actuators 123, and audio/video (A/V) system 124. I/O interface 104 may further receive from processor 101 and transmit to signal presenting interface 140 control signals for controlling light source 141 and/or audio signal system 142 to present locally perceivable signals to the operator. More exemplary functions of I/O interface 104 will be described later in connection with FIG. 4.

Figure 2:
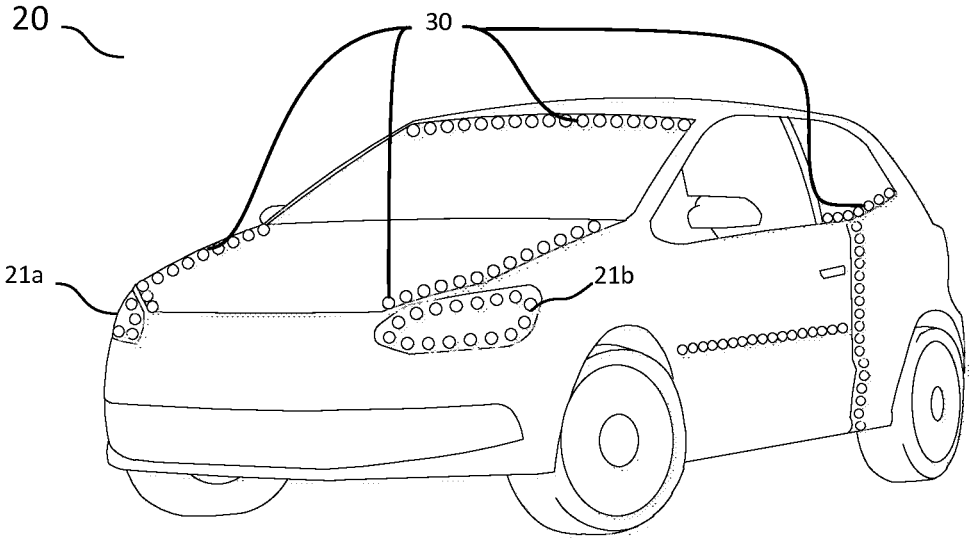
FIG. 2 is an exemplary front perspective view of a vehicle configured to implement the system of FIG. 1.

Communication interface 105 may be configured to transmit to and receive data from, among other devices, mobile device 220 and third party 230 over network 210. Network 210 may be any type of wired or wireless network that may allow transmitting and receiving data. For example, network 210 may be a wired network, a local wireless network, (e.g., Bluetooth™, WiFi, near field communications (NFC), etc.), a cellular network, an Internet, or the like, or a combination thereof. Other known communication methods which provide a medium for transmitting data between separate are also contemplated. More exemplary functions of communication interface 105 and network 210 will be described later in connection with FIGS. 2-4.

Control interface 120 may be configured to receive control signals from controller 100. Control interface 120 may also control lock mechanisms 121, vehicle starting system 122, actuators 123, and/or A/V system 124 based on the control signals. For example, if an operation request for unlocking a door of the vehicle has been granted, controller 100 may transmit a control signal to control interface 120, which may then control lock mechanism 121 to unlock the door. More exemplary functions of control interface 120, lock mechanisms 121, vehicle starting system 122, actuators 123, and A/V system 124 will be described later in connection with FIG. 4.

Signal presenting interface 140 may be configured to receive a control signal from controller 100. Based on the control signal, signal presenting interface 140 may also control light source 141 and/or audio signal system 142 to present a locally perceivable signal (a light and/or audio signal, or a combination of thereof) indicative of a passcode. For example, audio signal system 142 may generate a sound signal encoded by passcode information, based on a control signal received from controller 100. Light source 141 may be configured to present a locally perceivable light signal containing passcode information, dynamically or statically. Light source 141 may include any devices of the vehicle that may generate light, such as those shown in FIGS. 3 and 4.

Figure 3:
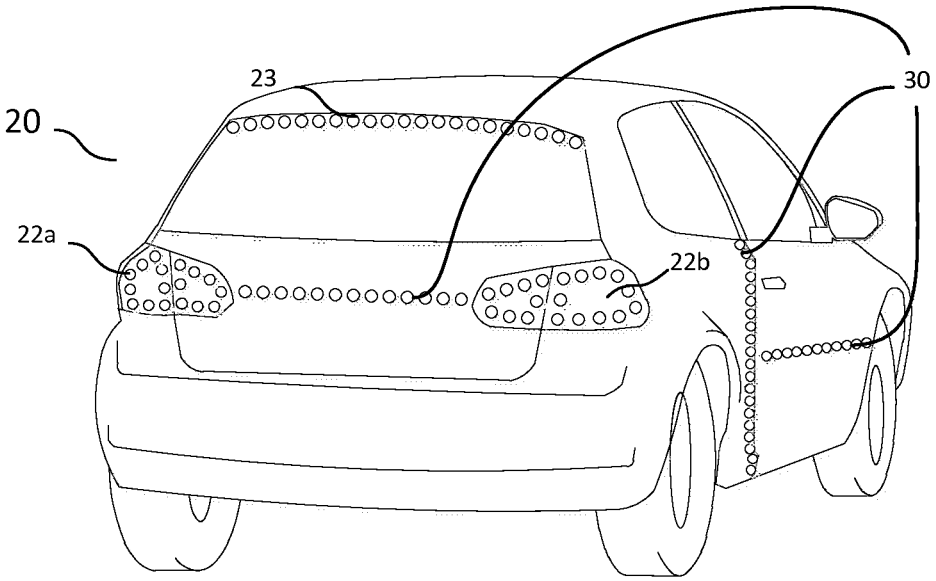
FIG. 3 is an exemplary back perspective view of a vehicle configured to implement the system of FIG. 1.
Figure 4:
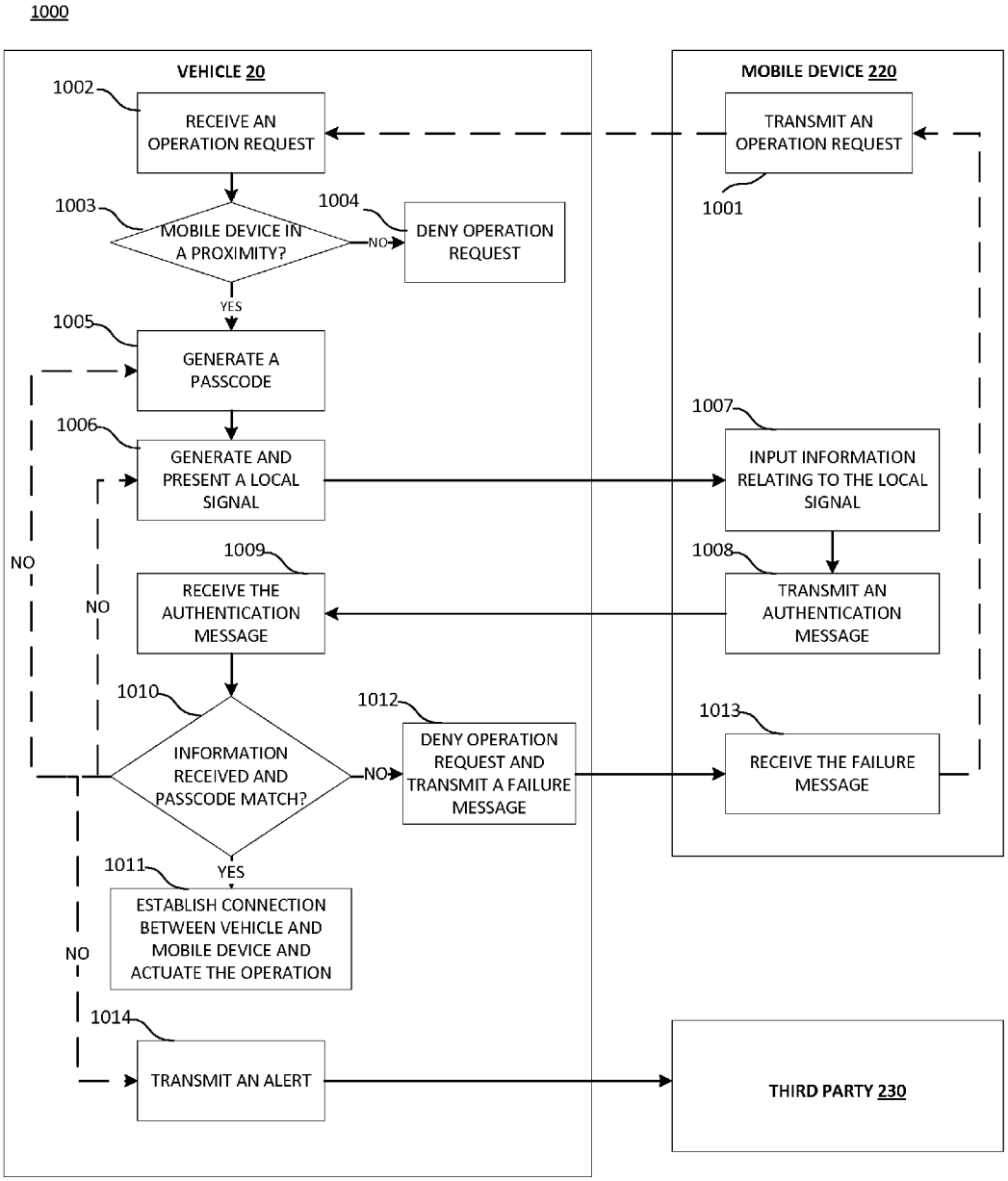
FIG. 4 is a flowchart of an exemplary process performed by the system of FIG. 1.

FIGS. 3 and 4 are exemplary front and back perspective views of an exemplary vehicle implementing system 10. As illustrated in FIGS. 3 and 4, light source 141 of vehicle 20 may include one or more of head lamps (e.g., 21*a* and 21*b*), corner lamps (not shown), daytime running lamps (not shown), tail lamps (e.g., 22*a* and 22*b*), center high mount stop lamp (e.g., 23), rear registration plate lamp (not shown), internal lamps (e.g., lamps located inside the vehicle on the ceiling of the vehicle) (not shown), and display devices (e.g., a display device located on a dashboard or central console) (not shown). In some embodiments, light source 141 may also include one or more light emitting diodes (LED) lights (e.g., 30), comprising one or more LED elements. An LED light may be located on a body frame, an outer belt line, a bump, a window, and/or a door. More exemplary functions of signal presenting interface 140, light source 141, and audio signal system 142 will be described later in connection with FIGS. 2-4.

Mobile device 220 may be any type of portable electronic communication device. For example, mobile device 220 may be a smart phone, a tablet, a personal computer, a wearable device (e.g., Google Glass™ or smart watches, and/or affiliated components), or the like, or a combination thereof. Mobile device 220 may include an input/output ("I/O"), a processor, a memory, and a storage (not shown). The I/O of mobile device 220 (e.g., a touch screen) may include a display configured to display information to the operator and/or receive input from the operator. For example, the I/O may display a user interface through which the operator may input (or select) a desired operation of the vehicle (e.g., unlocking a door of the vehicle). The processor of mobile device 220 may be configured to receive and process data and/or signals to perform exemplary functions of mobile device 220 disclosed in this application. For example, the processor of mobile device 220 may receive input regarding a desired operation of the vehicle. The processor may also generate and transmit to system 10 an operation request based on the operator's input. The memory and/or storage of mobile device 220 may store one or more computer programs that may be executed by the processor of mobile device 220 to perform exemplary functions of mobile device 220 disclosed in this application. The memory and/or storage of mobile device 220 may also be configured to store data and information used by the processor of mobile device 220. The processor, memory, and/or storage of mobile device 220 may have similar structures as processor 101, memory 102, and/or storage 103 of system 10 described above. More exemplary functions of the process, memory, and storage of mobile device 220 will be described later in connection with FIG. 4.

FIG. 4 is a flowchart of an exemplary process 1000 for authenticating a mobile device for operating a vehicle. At step 1001, the operator desiring to perform an operation of the vehicle may send an operation request to system 10 from a mobile device 220. Exemplary operations may include unlocking or locking a door of the vehicle (e.g., a side door or a trunk), opening a door, starting the vehicle, and/or controlling A/V system of the vehicle. Other operations of the vehicle are also contemplated. For example, an operator desiring to unlock a door of the vehicle may input a command of "unlock" through an application (not shown) installed on mobile device 220. Mobile device 220 may generate an operation request for unlocking the door based on the operator's input. Mobile device 220 may further transmit the operation request to controller 100 over network 210.

In some embodiments, an operation request generated and transmitted by mobile device 220 may include information relating to the operator and mobile device 220. Exemplary information may include an identity of the operator, an identity of mobile device 220, a location (and/or a position relative to the vehicle) of the operator (and/or any authorized person), the operation of the vehicle requested, and/or time information (e.g., a time of requesting the operation of the vehicle by the operator), etc. Other type of relevant information is also contemplated.

At step 1002, controller 100 may receive the operation request from mobile device 220 over network 210. At step 1003, controller 100 may determine whether mobile device 220 is within a predetermined proximity of the vehicle. For example, after controller 100 receives an operation request, sensor 130 may detect a position of mobile device 220 and transmit the detection data to controller 100 for processing. Controller 100 may determine whether mobile device 220 is within, for example, 10 feet of the vehicle, based on the detection data. If so (step 1003: yes), the authentication process may continue. On the other hand, if mobile device 220 (or the operator) is determined not to be within 10 feet of the vehicle (step 1003: no), controller 100 may deny the operation request at step 1004. In some embodiments, the predetermined proximity of the vehicle may be any distance between 0-250 feet, depending on the type of locally-perceivable signal generated by controller 100. For example, certain signals such as an audio signal may be perceivable at farther distance than other signals such as a scanable barcode.

In some embodiments, controller 100 may process the operation request based on the information included in the operation request. For example, the operation request may include information relating to the operator and/or mobile device 220, and the time of requesting the operation of the vehicle. Controller 100 may determine that the operator who requests starting the vehicle during night is a teenage, and may deny the operation request, although the operator may be allowed to operate the vehicle during day time. In some embodiments, rules for processing operation requests (e.g., denying an operation request or continuing the process for authentication) based on information included in operation requests may be modified by the owner and/or authorized persons. For example, the owner and/or authorized persons may determine what type of operations of the vehicle may be actuated during what time frame for an authorized person.

At step 1005, controller 100 may generate a passcode for authenticating mobile device 220. Any known algorithm for generating a passcode (e.g., a random or pseudo-random number) may be implemented in controller 100. In some embodiments, a generated passcode may be stored in memory 102 and/or storage 103 for future use (e.g., for comparing the passcode with the information relating to the passcode received from mobile device 220 as described below). In some embodiments, a passcode generated may include a decimal number, binary number, alphabetic characters, or the like, or a combination thereof.

In some embodiments, a passcode may be good for a one-time use (i.e., the passcode will be expired after one use). In some embodiments, a passcode may have a predetermined life span (i.e., the passcode will be expired within a predetermined period of time (e.g., 5 minutes) after being generated). In some embodiments, the predetermined life span of a passcode may be any time between 0-30 minutes.

At step 1006, controller 100 may instruct, via signal presenting interface 140, light source 141 and/or audio signal system 142 to generate a locally-perceivable signal containing information related to the passcode. At step 1007, the locally-perceivable signal may be received by mobile device 220. For example, the operator may manually input the passcode he saw, or mobile device 220 may automatically detect and receive the signal if it is machine-readable or machine-perceivable.

In some embodiments, a locally-perceivable signal may be a sound signal (human audible or non-audible), light signal (e.g., flash light), display pattern (static or dynamic), or the like, or a combination thereof. For example, controller 100 may instruct audio signal system 142 to generate a sound signal (human audible or non-audible) indicative of the passcode for authenticating mobile device 220. For example, the passcode information may be encoded by varying the number and sequence of the short and long beeps in the sound signal. For instance, audio signal system 142 may generate a sound signal including three short beeps followed by two long beeps. Such a signal may be captured by a microphone and processed automatically by an application installed on mobile device 220. The application may analyze the sound signal and derive information relating to the passcode based on the analysis.

Additionally or alternatively, controller 100 may send a control signal to light source 141 for generating a light signal and/or display pattern using one or more light sources (e.g., lamps, display devices (not shown), etc.) of vehicle 20. In some embodiments, controller 100 may instruct light source 141 (e.g., tail lamps 22*a* and 22*b*) to flash according to a certain sequence, based on the generated passcode. For example, controller 100 may generate a passcode "32" and may instruct tail lamps 22*a* and 22*b* to generate a long-flash three times followed by two short-flashes. The operator, after observing the flashes, may input "32" on mobile device 220. Alternatively, the operator may use a camera of mobile device 220 (not shown) to capture a video (or images) of the flashes, and mobile device 220 may analyze the captured video (or images) and derive information of the passcode (i.e., the passcode being "32") based on the analysis. In some embodiments, lamps may generate a light signal comprising flashes with the same duration, but certain lamp may represent a certain position of a digit of the passcode. For instance, using the same example of passcode "32," controller 100 may instruct left tail lamp 22*a* to generate a flash three times, representing "3" in the tens position, and right tail lamp 22*b* to generate a flash two times, representing "2" in the ones position.

In some embodiments, each of bulbs and/or LED element of light source 141 of vehicle 20 (including lamps and LED lights) may be configured to generate light with various light intensities, and each level of intensity may represent a different individual number or character of a passcode. For example, a lamp may have two different levels of light intensity, low and high. Low intensity may represent "1," high intensity may represent "2," and the lamp being off may represent "0." In some embodiments, each of bulbs and/or LED elements of light source 141 of vehicle 20 may be configured to generate light with various color (e.g., white, red, blue, yellow, orange, green, etc.), and each of the colors may represent different individual number or characters of a passcode. For example, white may represent "1," red may represent "2," and the lamp being off may represent "0."

In some embodiments, the passcode may be presented to the operator according to on/off statuses of individual lamps and/or LED elements of light source 141. For instance, controller may generate a binary passcode "110" and may instruct left tail lamp 22*a* and center high mount stop lamp 23 to be "on," which may represent the first two digits "11" of the passcode "110." Controller 100 may also instruct right tail lamp 22*b* to be "off," representing the last digit "0" of the passcode "110." In some embodiments, the operator, after observing the lights of the vehicle, may select the lamps that are on from a user interface of an application installed in mobile device 220. For example, if left tail lamp 22*a* and center high mount stop lamp 23 are on, and right tail lamp 22*b* is off, the operator may select left tail lamp 22*a* and center high mount stop lamp 23 at a user interface, which represents a passcode of "110." In other embodiments, the operator may use a camera of mobile device 220 to capture signal presented at light source 141 (e.g., the back of vehicle 20). Mobile device 220 may derive information relating to the passcode from the captured image. In other embodiments, the passcode may be presented to the operator according to on/off statues of individual LED elements of the lamps and/or LED lights.

In some embodiments, LED elements of the lamps and/or LED lights may be configured to display alphanumeric characters of the passcode or a machine-readable pattern representing the passcode. For example, controller 100 may instruct LED elements of the lamps and/or LED lights to display the passcode "32." In some embodiments, LED elements of the lamps and/or LED lights may display a machine-readable pattern (e.g., a barcode or barcode-like pattern), and the operator may use mobile device 220 to scan the pattern, e.g., a camera of mobile device 220. Mobile device 220 may derive information relating to the passcode from the scanned pattern. In some embodiments, light source 141 may include a display configured to display the passcode (e.g., "32") or a machine-readable pattern (e.g., a barcode or barcode-like pattern), and the operator may use mobile device 220 to receive the information relating to the passcode accordingly.

In some embodiments, controller 100 may determine a location of the operator and instruct the lamps and/or LED lights that are closest to the operator to present a light signal representing the passcode. For example, controller 100 may determine that the operator is in front of vehicle 20 by extracting the position information from the operation request or sensing the mobile device or operator by sensor 130. Controller 100 may instruct the lamps and/or LED lights located in front of vehicle (e.g., head lamps 21*a* and 21*b*) to present a light signal to the operator. In another example, controller 100 may determine that the operator is sitting in the driver's seat and may instruct one or more light source and/or audio system located inside the vehicle to present the signal indicative of the passcode.

After receiving information representing the passcode, at step 1008, mobile device 220 may generate an authentication message including the information relating to the passcode, and may transmit the authentication message to system 10 over network 210. At step 1009, controller 100 may receive the authentication message from mobile device 220 over network 210. Controller 100 may compare the information relating to the passcode in the authentication message with passcode information stored in its local storage such as memory 102 and/or storage 103.

At step 1010, controller 100 may determine whether the information relating to the passcode received from mobile device 220 matches with the passcode previously generated at 1003 and stored in the local storage. If they match (step 1010: yes), controller 100 may authenticate the mobile device 220 and establish a connection between vehicle 20 and mobile device 220 in step 1011. Controller 100 may also actuate the operation of the vehicle requested by the operator. For example, controller 100 may control lock mechanism 121 to unlock a door of the vehicle via control interface 120. In some embodiments, controller 100 may allow the operator and/or mobile device 220 to operate the vehicle within a predetermined period of time, without re-authenticating mobile device 220. The predetermined period of time may be any time between 0 second to, for example, 1 hour.

In some embodiments, re-authenticating of mobile device 220 may be required if the connection between mobile device 220 and controller 100 breaks, for example when mobile device 220 leaves the predetermined proximity of vehicle 20.

On the other hand, if the information relating to the passcode received from mobile device 220 does not match with the passcode locally stored (step 1010: no), controller 100 may deny the operation request at step 1012. Controller 100 may further transmit a failure message to mobile device 220, indicating that the passcode information is incorrect. Controller 100 may also request the operator to re-enter and/or re-transmit the information relating to the passcode. Additionally or alternatively, controller 100 may re-generate a locally perceivable signal (at step 1006) based on the same passcode generated (at step 1005). In other embodiments, instead of generating a signal based on the same passcode, controller 100 may generate a new passcode (at step 1005) and instruct light source 141 and/or audio signal system 142 to present a locally perceivable signal based on the new passcode (at step 1006). The authentication process may continue (steps 1007 through 1011/1012, if applicable) as described in this application.

In some embodiments, after receiving a failure message from system 10, mobile device 220 may send a new operation request to system 10 (at step 1001), and the authentication process may continue (steps 1002 through 1011/1012, if applicable) as described in this application.

In some embodiments, after a predetermined number of failed attempts for authenticating, at step 1014, controller 100 may generate an alert indicating that an unauthorized operation of the vehicle is attempted. Controller 100 may transmit the alert to the owner, an authorized person, and/or a third party 230 (e.g., a police station or security firm) over network 210. The alert may include information relating to the vehicle, identification of the operator and/or mobile device 220 (or a device pretending to be mobile device 220), the time and location of the incidence, etc. The predetermined number of failed attempts after which an alert will be generated and transmitted may be any number between 1 to 20.

While illustrative embodiments have been described herein, the scope of any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the disclosure. The examples are to be construed as non-exclusive. Furthermore, the steps of the disclosed routines may be modified in any manner, including by reordering steps and/or inserting or deleting steps. In particular, non-dependent steps may be performed in any order, or in parallel. It is intended, therefore, that the specification and examples be considered as illustrative only, with a true scope and spirit being indicated by the following claims and their full scope of equivalents.

What is claimed is:

1. A method for authenticating a mobile device for operating a vehicle, comprising:

receiving, by a receiver of the vehicle, an operation request from the mobile device to actuate an operation of the vehicle;

generating, by a controller of the vehicle, a locally-perceivable signal indicative of a passcode granting a connection with the mobile device, in response to the received operation request, wherein the signal indicative of the passcode comprises light displayed by an external lighting element of the vehicle;

receiving, by the receiver of the vehicle, information relating to the passcode from the mobile device; and establishing the connection with the mobile device for actuating the operation of the vehicle if the received information is authenticated.

2. The method of claim 1, wherein the passcode is a one-time passcode.

3. The method of claim 2, wherein the one-time passcode is set to expire within a predetermined period of time after the locally-perceivable signal is generated.

4. The method of claim 1, further including detecting that the mobile device is within a predetermined proximity of the vehicle before generating the locally perceivable signal.

5. The method of claim 1, wherein the signal indicative of the passcode further comprises a machine-readable code readable by the mobile device.

6. The method of claim 1, wherein the signal indicative of the passcode further comprises an audible signal perceivable by the mobile device.

7. The method of claim 1, wherein the operation of the vehicle includes one of unlocking a door of the vehicle or starting the vehicle.

8. The method of claim 1, wherein the external lighting element includes one or more Light-emitting diode (LED) elements.

9. A system for authenticating a mobile device for operating a vehicle, the system comprising:

a receiver configured to receive an operation request from the mobile device to actuate an operation of the vehicle; and a controller configured to generate a locally-perceivable signal indicative of a passcode granting a connection with the mobile device, in response to the received operation request, wherein the signal indicative of the passcode comprises light displayed by an external lighting element of the vehicle, and wherein the receiver is further configured to receive information relating to the passcode from the mobile device, and the controller is further configured to establish the connection with the mobile device for actuating the operation of the vehicle if the received information is authenticated.

10. The system of claim 9, wherein the passcode is a one-time passcode.

11. The system of claim 9, wherein the one-time passcode is set to expire within a predetermined period of time after the locally-perceivable signal is generated.

12. The system of claim 11, further comprising a sensor configured to detect that the mobile device is within a predetermined proximity of the vehicle before generating the locally perceivable signal.

13. The system of claim 9, wherein the signal indicative of the passcode further comprises a machine-readable code readable by the mobile device.

14. The system of claim 9, wherein the signal indicative of the passcode further comprises an audible signal perceivable by the mobile device.

15. The system of claim 9, wherein the operation of the vehicle includes one of unlocking a door of the vehicle or starting the vehicle.

16. A non-transitory computer-readable medium storing instructions that, when executed, cause one or more processors to perform a method for authenticating a mobile device for operating a vehicle, the method comprising:

receiving an operation request from the mobile device to actuate an operation of the vehicle;

generating a locally-perceivable signal indicative of a passcode granting a connection with the mobile device, in response to the received operation request, wherein the signal indicative of the passcode comprises light displayed by an external lighting element of the vehicle;

receiving information relating to the passcode from the mobile device; and establishing the connection with the mobile device for actuating the operation of the vehicle if the received information is authenticated.

* * * * *